US006220174B1

(12) United States Patent
Gudel et al.

(10) Patent No.: US 6,220,174 B1
(45) Date of Patent: Apr. 24, 2001

(54) GUIDANCE SYSTEM WITH A TRUCK GUIDED ON A RAIL

(75) Inventors: Rudolf Gudel, Rutschelen; Walter Zulauf, Ursenbach; Hans-Ulrich Kurt, Kriegstetten, all of (CH)

(73) Assignee: Gudel AG, Langenthal (CH)

( * ) Notice: Subject to any disclaimer, the term of this patent is extended or adjusted under 35 U.S.C. 154(b) by 0 days.

(21) Appl. No.: 09/291,976

(22) Filed: Apr. 15, 1999

(30) Foreign Application Priority Data

Apr. 16, 1998 (EP) ..... 98810330

(51) Int. Cl.[7] ..... B61C 13/00
(52) U.S. Cl. ..... 105/29.1; 105/30
(58) Field of Search ..... 105/29.1, 106, 105/119, 144, 30, 32, 33, 29.2; 414/728, 736

(56) References Cited

U.S. PATENT DOCUMENTS

| | | | | |
|---|---|---|---|---|
| 4,318,665 | * | 3/1982 | Carroll et al. | 414/728 |
| 4,563,956 | * | 1/1986 | Wiechert et al. | 105/29.1 |
| 5,027,712 | * | 7/1991 | Wallick | 105/29.2 |
| 5,069,141 | * | 12/1991 | Ohara et al. | 105/30 |
| 5,092,249 | * | 3/1992 | Knuettel | 105/30 |
| 5,398,617 | * | 3/1995 | Deandrea | 105/29.1 |
| 5,562,043 | * | 10/1996 | Gromes | 105/29.1 |
| 5,735,214 | * | 4/1998 | Tsuboi | 105/29.1 |
| 5,924,365 | * | 7/1999 | Pircher | 105/29.1 |

FOREIGN PATENT DOCUMENTS

| | | |
|---|---|---|
| 3031355A1 | 4/1982 | (DE) . |
| 92147380 | 12/1993 | (DE) . |
| 2336287 | 7/1977 | (FR) . |
| 97 37881 | 10/1997 | (WO) . |

* cited by examiner

*Primary Examiner*—Stephen Avila
*Assistant Examiner*—Lars A. Olson

(57) ABSTRACT

A guidance system with a truck guided on a rail (1) has available laterally arranged guiding surfaces (2.1, 2.2) for guide rollers of the truck. A rack (4) is preferably constructed on the rail (1) such that a dividing line (6) of a gearing (5) of the rack (4) constantly runs through a median perpendicular (7) of the cross-section of the rail (1). Each truck has, for example, two wheel frames. The wheel frames are preferably so constructed that the swivel axis (22) runs through a power application point (14) of the dividing line (6). The guiding elements form a three-point guidance system.

9 Claims, 3 Drawing Sheets

GUIDANCE SYSTEM WITH A TRUCK GUIDED ON A RAIL

TECHNICAL AREA

Figure 1:
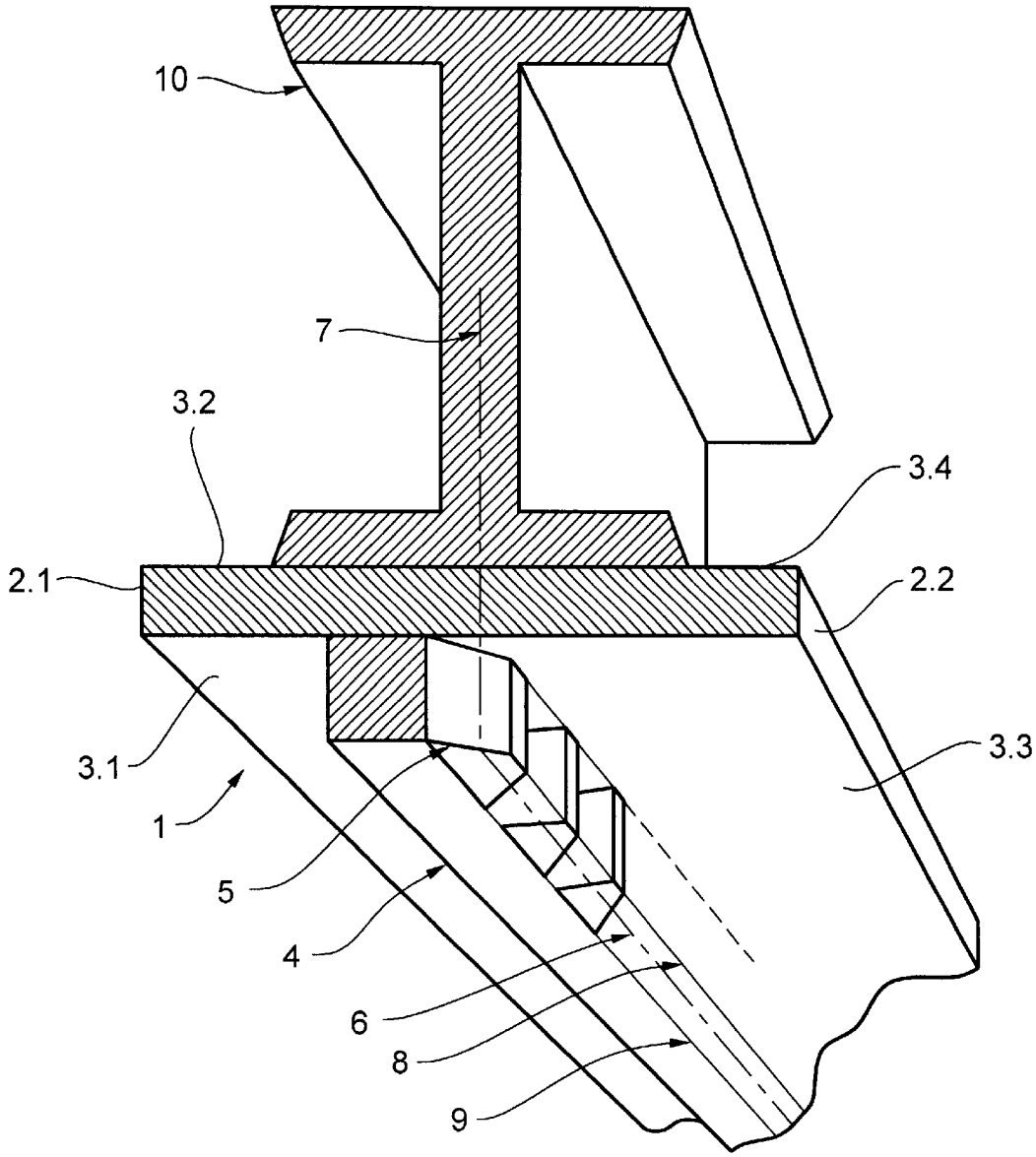

The invention concerns a guidance system with a truck guided on a rail whose drive gear engages into a gearing of the rail in a power application point and whose guidance elements are led in appropriate points of support on laterally arranged guidance surfaces. Furthermore, the invention relates to a rail and to a truck for such a guidance system. State of the art Conveyance systems, which can move up to specified positions, are needed in automatic manufacturing, for example. The workpieces can be transported with such a conveyance system from one processing station to the next and there be transferred automatically.

Systems in connection with which the individual transport cars run on metal rails with rollers are known in the art. The rollers are typically driven by electric motors. The roller drive indeed makes possible a great freedom in establishing the course of the rails as stretches with varying radii of curvature can be constructed without difficulty. Roller drives are nonetheless not exact as to position (owing to slippage). Correspondingly, the position can only be reached by additional position sensors and associated control circuits. In a facility with a great number of trucks, block control must be provided in addition for safety reasons.

It is known that exactitude of position can be reached with, for example, gear and spindle gear drives. Such drives find use, for example, in connection with machines with processing units movable to exact positions (milling cutter, drill, etc.). A typical area of application is a power bogie or rotary table of an automatic assembly machine. The traverse is exactly determined by the number of rotations of the pinion or driving gear wheel.

The known gear drives, however, are only suited for executing either exclusively linear or exclusively rotary movements.

PRESENTATION OF THE INVENTION

The object of the invention is to indicate a guidance system of the type named at the beginning, which combines positional exactitude and largely free linear guidance.

Accomplishing the object is defined by the features of claim 1. In accordance with the invention, a rack is constructed on the rail such that the dividing line of the gearing has a predefined constant distance from at least one lateral guide surface. The truck has a guiding element, which is led on the lateral guiding surface in a point of support, and a drive gear, which engages into the rack at a power application point. Drive gear and guiding element are so arranged that the straight line connection defined by the power application point and point of support is always perpendicular to the current direction of travel. The momentary direction of travel is defined by the tangentials of the dividing line.

Owing to the geometrical construction of the gearing according to the invention, a gear wheel-driven guidance system with largely optional rail guidance can be realized. Not only left as well as right curves, in addition to straight segments, but also various curve radii can be integrated into the same facility.

The dividing line preferably runs through a median perpendicular of the cross-section of the guiding rail. Extramedian arrangements are likewise possible. Guide rollers are usually used as guiding elements, but sliding elements are also possible.

A truck of the invention has at least one, preferably two wheel frames. These are so constructed that when direction is changed, the axis of rotation or pivoting of the wheel frame runs through the gearing dividing line. The pivoting axis thus passes through the power application point and is parallel to an axis of rotation of the drive gear. (If the truck has but a single wheel frame then the center of gravity of the truck should lie on the swivelling axis mentioned. This way, it is assured that the driving force (force of acceleration or braking force) generates no reaction moment of rotation on the truck (or its wheel frame).)

In accordance with an especially preferred embodiment, the wheel frame has a three-point guidance. That means that lateral guidance or control of direction is basically assumed by the three rollers. Two rollers run on one guide surface, only one on the other. The three points of lateral guidance form an isosceles triangle with an angular aperture, for example, from 30° to 40°.

Advantageously, two of the three rollers are sprung. It is a matter of those that are arranged on the same side and that consequently run on the same guide surface. More than three guide rollers can also be provided (whereby the number of the spring actions is to be accordingly adapted). If only two guide rollers are provided symmetrically to the swivelling axis of the wheel frame, stabilization can become a problem (vibrations, rolling motions).

The preferred construction of the three-point guidance permits a geometrically exact gear engagement for any desired curve radius.

Preferably the weight of the car is borne by separate track-supporting rollers. These do not need to be sprung. The rail has, for example, a basically flat cross-section whose exterior narrow sides form the guidance surfaces and whose top- and bottom-lying areas in the marginal area form the running surfaces for the track-supporting rollers. According to whether the trucks stand on the rails or are suspended from it, the rack is on the upper or lower broad side of the rail.

The guide rail and the rod must be made with high precision. The two parts can be manufactured individually and then joined with each other (screwed, welded). So that the shape of the gearing in the curves is correct, two identical straight racks can be laid one into the other and then be bent into the desired radius together, but it is also possible for the guide rail and rack to be milled directly from a single workpiece. The guide rail is advantageously fastened with a carrier, which has the necessary static loading capacity so that the precision-manufactured component of the rail system can be held to a minimum, as far as dimensions and weight are concerned. The carrier can be a typical double T carrier without special precision criteria. The rail is preferably fastened basically over its entire length (for example, by fastening elements at regular distances) so that their internal stability is also guaranteed. Finally, a power rail can also be fastened on the carrier.

The guidance system of the invention can have a modular construction. That means, varying rail elements (straight, curved to the left, curved to the right) can be made available, which can be assembled by the user according to his needs into an individual transport system. In combination with switches, crossovers, or even lift stations, there emerges a broad spectrum of possibilities.

Further advantageous embodiments and combinations of features of the invention emerge from the subsequent detailed description and the totality of the patent claims.

SHORT DESCRIPTION OF THE DRAWINGS

Figure 2:
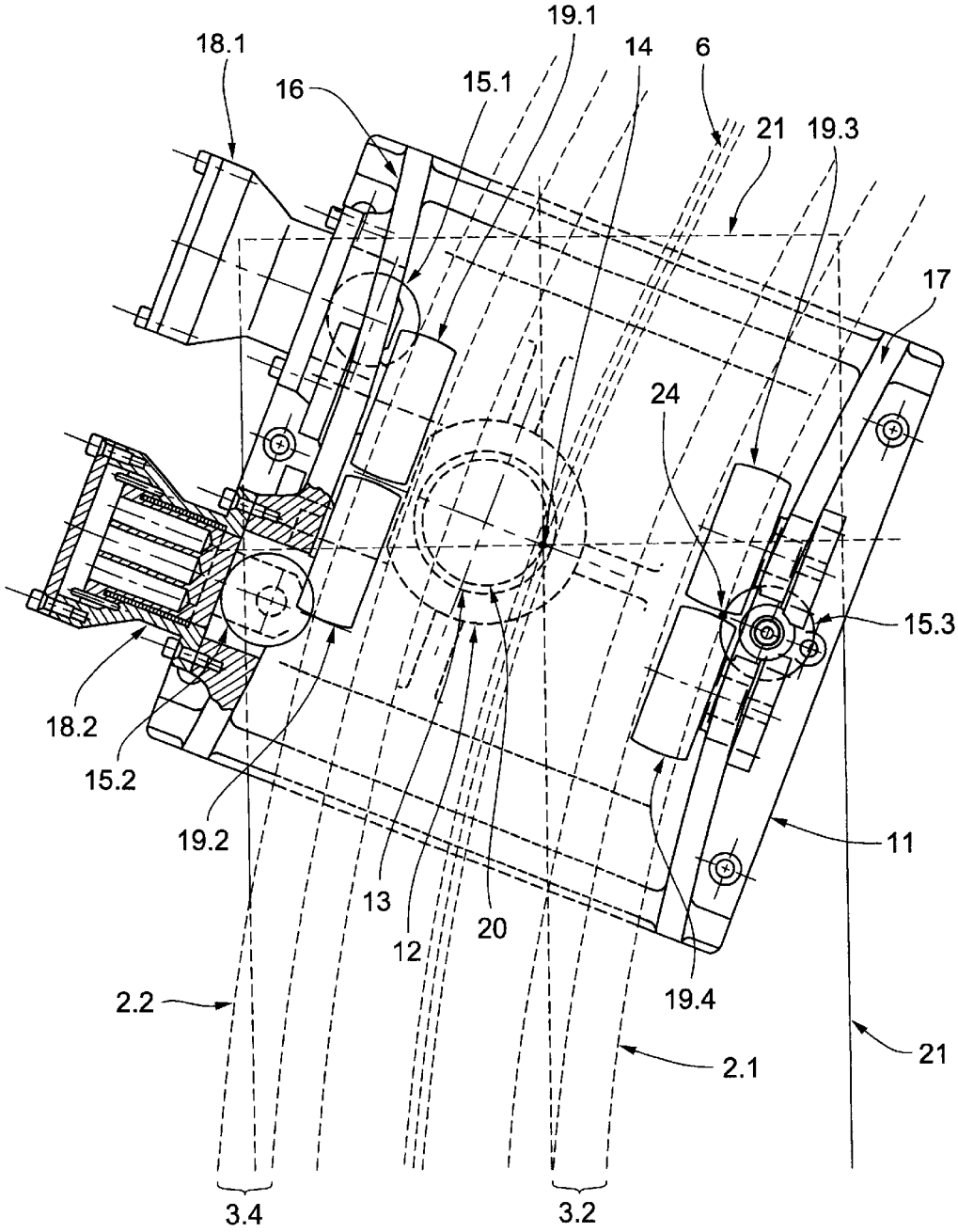
Figure 3:
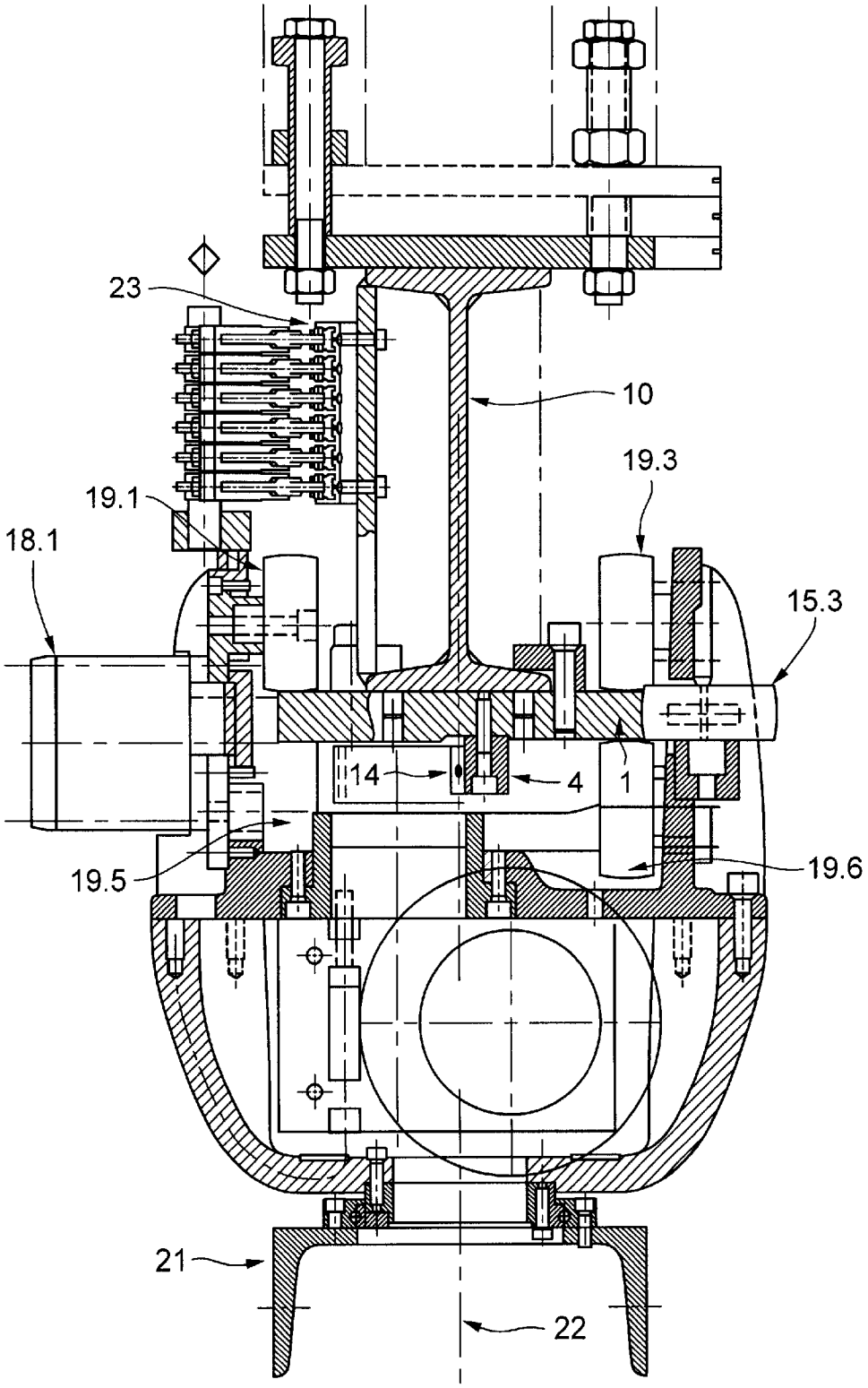

The drawings for explanation of the embodiment show:

FIG. 1 A schematic perspective representation of the shape of the rail of the invention;

FIG. 2 A schematic representation of the guiding of a truck on a curved rail in plan view;

FIG. 3 A schematic representation of the arrangement depicted in FIG. 2 in cross-section.

Basically identical parts are provided with the same reference numbers in the figures.

Ways of Constructing the Invention

FIG. 1 schematically represents the principle of the invention. A rail 1 is applied at the foot of a double T carrier 10, for example. The rail 1 has the form of a plate or a strip-like or band-like flat element and consists of a high grade steel. The narrow sides 2.1, 2.2 serve as lateral guide surfaces, the lower and upper edge surfaces 3.1, 3.3 or 3.2, 3.4 as running surfaces.

A rack 4 is installed on the underside of the rail 1 in the area between the edge surfaces 3.1 and 3.3. Its gearing 5 is arranged in accordance with a preferred embodiment such that its dividing line 6 runs exactly in the middle of the rail 1.

Specifically, the following should be noted: In cross-section in relation to the longitudinal direction of the rail 1, the dividing line 6 (or its point of intersection through the cross-section plane) lies on the median perpendicular 7 of the (in the present example) mirror symmetrically constructed rail 1. In other words: If one proceeds from the assumption that the two narrow sides 2.1, 2.2 define two parallel planes, and one defines a third plane exactly in the middle between these two imaginary planes, the dividing line 6 of the gearing 5 lies on this third plane.

The axis of rotation of the drive gear stands parallel to the median perpendicular 7 (thus vertically and not horizontally, in FIG. 1). Correspondingly, the gearing 5 points in a horizontal direction.

The geometrical orientation can be described as follows: A foot rule 9 and a top line 8 are allocated to the gearing 5. (If the rack 4 is curved, it is possible to speak of a root circle instead of a foot rule 9, of a crown circle instead of a top line 8, and of a dividing circle or even roller circle instead of a dividing line 6). The foot rule 9 and the top line 8 lie almost on two different sides of the median perpendicular 7. It basically does not matter whether the foot rule 9 is arranged on the left in relation to the median perpendicular 7 (that is, on the side facing the narrow side 2.1) or on the right, that is, whether the gearing points to the left or to the right.

FIG. 2 and 3 show how a wheel frame 11 of the rail 1 of the invention is guided. The rail 1 is regarded from above in the representation in FIG. 2. The truck 21 is situated below the rail 1 and is, for example, suspended flexibly on two identical wheel frames. FIG. 3 shows the same construction in cross-section.

Three guide rollers 15.1 through 15.3 are provided for lateral guidance in terms of the especially preferred embodiment of the invention. The guide rollers 15.1 and 15.2 are supported on a first side wall 16 of the wheel frame 11. Two spring suspensions 18.1, 18.2 press the two guide rollers 15.1 and 15.2 on the narrow side 2.2. The third guide rail 15.3 is supported unsprung on an opposite-lying side wall 17 of the wheel frame 11.

The distance between the two side walls 16, 17 is somewhat larger than the breadth of the rail 1, so that the wheel frame can embrace the rail 1 unshaped. Furthermore, in the present example, the side walls 16, 17 are curved toward the narrow sides 2.1, 2.2 or the rail 1. In harmony with the smallest curvature radii of the rails present in the system, they thus easily diverge toward the outside from the center of the wheel frame.

The axes of rotation of the three guide rollers 15.1 to 15.3 form the comers of an isosceles triangle. (The two equal sides of the triangle are formed by the straight lines connecting the axes of the guide rollers 15.1 and 15.3 on the one hand and 15.2 and 15.3 on the other.) The angular aperture of the triangle preferably lies in the area between 30° and 40°. If the angular aperture is too small, the stability of the guide system suffers. That is, pendulum or rolling motions about a vertical axis can occur. If the angle mentioned is too large, the sprung guide rollers 15.1 and 15.2 must have unnecessarily large spring elongations (this especially when relatively narrow curves are to be traveled over or if sharply differing curvature radii are present).

One of the two guide rollers 15.1 and 15.2 is constantly running ahead and one running behind. For example, with the transition from a straight stretch into a curved one, the springs 18. 1, 18.2 provide for a soft introduction of the change in direction or wheel frame pivoting motion.

The point of support 24 of the guide roller 15.3 on the narrow side 2.1 is clearly fixed in relation to the wheel frame 11 because the guide roller 15.3 mentioned is neither supported with springs nor is elastic itself The distance between gear wheel 13 and guide roller 15.3 is constant. In accordance with the invention, the direction defined by power application point 14 and point of support 24 is always perpendicular to the direction of travel at the moment. The latter is defined by the tangents on the dividing line in the power application point 14.

An important aspect of the invention lies in that the pivoting axis (standing perpendicular to the drawing plane in FIG. 2) (cf. reference number 22 in FIG. 3) of the wheel frame 11 runs precisely through the power application point 14 of the dividing line 6 of the gearing 5. This is independent of the rail 1 being straight or curved (with any radius whatsoever toward the left or right).

A truck 21 typically has two wheel frames. One has available an electric drive 12, the gear wheel 13 of which engages into the gearing 5 of the rack 4. The dividing line 2.1 has a constant distance from the narrow side 2.1 along the rail 1, which guides the guide roller 15.3. The rack 4 is situated between the gear wheel 13 and the rigid guide roller 15.3.

The position of the truck 21 can be exactly controlled with a numerically controlled motor. Current and control signals can be picked up with a current collector from, for example, a power rail 23 installed on the carrier 10 (cf. FIG. 3).

By the swivel axis 22 running through the power application point (contact point between the gearing 5 and the gear wheel 13 or contact point of the dividing line 6 with the rolling circle or dividing circle 20 of the gear wheel 13), no torque is exerted on the wheel frame by starting or braking. The undesirable pendulum or rolling motions mentioned further above can thus not be induced. Furthermore, a geometrically exact gear engagement is guaranteed.

In addition to the three guide rollers 15.1 to 15.3, four tread rollers are provided on each side wall 16 or 17. The four tread rollers 19.1 to 19.4 running on the upper side, that is, on edge surfaces 3.2 and 3.4, are drawn in FIG. 2. The tread roller pairs 19.1/19.2 or 19.3/19.4 are mounted at a small mutual distance. (The two tread rollers 19.1 and 19.2 find room in the longitudinal segment delimited by the guide rollers 15.1, 15.2 in the present example.) The axis of guide roller 15.3 is situated in the center between the tread rollers 19.3 and 19.4.

Symmetrically to the four tread rollers 19.1 to 19.4 above, four further tread rollers are provided on the underside (in FIG. 3, only two of these further four tread rollers are represented, cf. reference numbers 19.5 and 19.6). The wheel frame 11 cannot tip over due to this roller arrangement.

The embodiment described can be modified in manifold ways within the framework of the invention. The wheel frames can also be arranged standing instead of hanging. The rail can also be inclined.

There must not necessarily be a functional separation between the guide rollers and the tread rollers or support rollers. That is, a construction can also be selected in connection with which certain rollers serve for guiding the car as well as for supporting weight. The rail can, for example, also be symmetrically sloped on the lateral edges. It is even conceivable that the cross-section of the rail is not symmetrical.

The rail as a rule runs in one plane. That means that the curvature radii lie in the plane defined by the strip form of the rail. It is not ruled out, however, that the direction of the rail is led out of this plane by slow changing over a large stretch ("flat ramp").

Obviously, it is not necessary for the rail to be supported by a double T carrier or something similar. It can quite easily be self-supporting.

According to the application, the guide rollers can be hard or elastic. Under certain circumstances, an elastic tire can make a sprung support unnecessary (for example, if the curvature radii are very large).

In conclusion, it should be stated that due to the invention, a guidance system has been created that facilitates an exact positioning with any desired line guidance with relatively low-control technological expenditure. In addition, the invention has many applications, be it in a large machine with computer controlled workpiece processing or as a transportation system in manufacturing facilities or even in amusement parks.

What is claimed is:

1. Guidance system with a truck guided on a rail whose drive gear engages into a gearing of the rail in a power application point and whose guide elements are guided in corresponding points of support on laterally arranged guide surfaces, wherein a dividing line of the gearing has a predefined constant distance from at least one of the lateral guide surfaces, and the drive gear and guide elements are so arranged that a straight line through the power application point and a point of support is always perpendicular to the direction of travel at the moment, wherein the truck has at least one wheel frame (11) whose swivel axis (14) runs through the power application point of the dividing line (6).

2. Guidance system according to claim 1, wherein the dividing line (6) of a gearing (5) of the rack (4) always runs through a median perpendicular (7) of the cross-section of the rail (1).

3. Guidance system according to claim 1, wherein the guide elements (15.1 to 15.3) form a three-point guidance system.

4. Guidance system according to claim 3, wherein two guidance elements (15.1, 15.2) led on the same guide surface are spring-mounted (15.1, 15.2).

5. Guidance system according to claim 1, wherein tread rollers (19.1 to 19.4) are provided which engage on the rail (1) from above and below.

6. Guidance system according to claim 1, wherein the rail (1) is basically constructed in strip form and is attached on a carrier (10).

7. Guidance system according to claim 1, wherein the rail (1) has straight segments as well as segments curved to the left and right.

8. Rail (1) for a guidance system according to claim 1, having a rack (4) such that a dividing line (6) of a gearing (5) of the rack (4) constantly runs through a median perpendicular (7) of the cross-section of the rail (1).

9. Wheel frame for a truck for a guidance system according to claim 1, wherein a geometrical arrangement of the guide elements (15.1 to 15.3) is selected with reference to a driving gear (13) such that a swivel axis (14) to the wheel frame (11) runs through a point of a rolling circle of a gear wheel (13).

* * * * *